US005293999A

United States Patent [19]

Linngren

[11] Patent Number: 5,293,999

[45] Date of Patent: Mar. 15, 1994

[54] DISPENSER FOR PADDED TAPE HANDLES

[75] Inventor: Leslie E. Linngren, Fridley, Minn.

[73] Assignee: Minnesota Mining and Manufacturing Company, St. Paul, Minn.

[21] Appl. No.: 15,402

[22] Filed: Feb. 9, 1993

[51] Int. Cl.[5] ..... B65D 85/00

[52] U.S. Cl. ..... 206/525; 206/526; 206/447

[58] Field of Search ..... 206/447, 485, 477, 525, 206/526, 554; 248/309.1; 211/88

[56] References Cited

U.S. PATENT DOCUMENTS

| | | | |
|---|---|---|---|
| 3,043,487 | 7/1962 | Fowle | 206/455 |
| 4,211,328 | 7/1980 | Petranyi206 | 525/ |
| 4,527,693 | 7/1985 | Membrino | 206/526 |
| 4,613,049 | 9/1986 | Walker | 211/88 |
| 4,691,822 | 9/1987 | Malancon, Jr. | 206/525 |
| 4,746,018 | 5/1988 | Mueller | 206/447 |
| 4,848,571 | 7/1989 | Fullar | 206/493 |

*Primary Examiner*—Paul T. Sewell
*Assistant Examiner*—Marie Denise Patterson
*Attorney, Agent, or Firm*—Gary L. Griswold; Walter N. Kirn; Leland D. Schultz

[57] ABSTRACT

Disclosed is a dispenser for padded tape handles.

8 Claims, 4 Drawing Sheets

DISPENSER FOR PADDED TAPE HANDLES

FIELD OF THE INVENTION

This invention relates to dispensers for padded tape handles.

BACKGROUND OF THE INVENTION

Tape handles have been provided for adherence to an object to facilitate carrying and manipulation of the object. As shown in FIG. 1, a tape handle 10 is constructed with a flexible backing strip 12, usually polymeric. The tape handle includes an intermediate non-adhesive portion and a pair of end portions on either side of the intermediate non-adhesive portion. Each of the end portions are coated with a layer of pressure sensitive adhesive. In FIG. I, the tape handle 10 includes one major surface 14 coated with a layer 16 of pressure sensitive adhesive. Intermediate portion 20 of the layer of pressure sensitive adhesive is then masked or covered by a deadening strip 18, with both ends 22 and 24 of the layer of pressure sensitive adhesive on either side of the deadening strip remaining exposed and provided to adhere the tape handle to an object 26, such as a package, at spaced locations, as shown in FIG. 2. The intermediate, masked portion 20 projects away from the object to form a loop 28 that is presented for manual engagement and the end portions adhere to the object with sufficient strength to enable the package to be lifted, carried or otherwise manipulated by grasping the handle.

Alternatively, the flexible backing strip 12 may be preferentially coated with a layer of pressure sensitive adhesive adjacent either end 22, 24 of major surface 14 of backing strip 12, with a intermediate portion of that major surface remaining uncoated.

Since the tape handles are generally considered disposable once applied to an object, it is desirable to provide multiple tape handles in a form that is convenient to store and to dispense individual tape handles when needed. Although a plurality of tape handles may be detachably sequentially secured in end to end relation and stored in roll form, it is desirable in many situations to reciprocally releasably adhere a plurality of the tape handles to each other with the pressure sensitive adhesive coated portions of one tape handle releasably securing the tape handle to an adjacent tape handle in pad form, as shown in FIG. 1, extending from an uppermost tape handle 10*a*, to a lowermost tape handle 10*b*. It is to be understood that the terms "uppermost" and "lowermost" as applied to the present invention do not refer to the actual physical orientation of the pad, but rather to the relative positions of individual tape handle with respect to the pad of tape handles and the sequence in which the tape handles are most conveniently dispensed from the pad.

Such tape handle pad constructions 30 conventionally include a removable release liner 32 covering the exposed pressure sensitive adhesive surfaces of the lowermost tape handle. Of course, padded tape handles may be provided in a number of different arrangements utilizing varying methods of construction.

Ordinarily, the pad 30 of tape handles as shown in FIG. 1, must be grasped in one hand while the uppermost individual handle 10 is grasped by the other hand and pulled away from the pad. Once separated, the pad of handles is released and both hands are required to apply the separated tape handle to an object, as in FIG. 2. This is a somewhat cumbersome and time consuming operation. Simply removing the release liner from the pad and applying the lowermost tape handle to a surface to secure the pad to the surface has been found to be unsatisfactory in that each sequential uppermost tape handle that is removed from the pad has an undesirable tendency to curl or adhere to itself before the tape handle can be applied to an object.

Thus, in many situations, it would be desirable to provide a dispenser to conveniently, rapidly and repeatedly present the pad of tape handles for sequential dispensation of individual tape handles, preferably with one hand.

SUMMARY OF THE INVENTION

Disclosed is a dispenser for a pad of reciprocally releasably adhered tape handles extending from an uppermost tape handle to a lower most tape handle. Each of the handles has an intermediate non-adhesive portion and pressure sensitive adhesive coated end portions on either side thereof. The dispenser includes a body having a pair of aligned, opposing laterally spaced surfaces, each of the laterally spaced surfaces for receipt of one of the pressure sensitive adhesive coated end portions of the lowermost tape handle in the pad of tape handles to secure the pad of tape handles to the dispenser. The intermediate non-adhesive portion of the tape handles in the pad extend to form a loop adapted for manual engagement to facilitate sequential dispensing of individual tape handles from the pad.

In one embodiment, the dispenser body includes a base having a pair of opposing, laterally spaced side plates extending from the base. The side plates each have one of the aligned opposing laterally spaced inner surfaces, preferably parallel, adapted for receipt of and adherence to one of the pressure sensitive adhesive coated end portions of a tape handle.

In another embodiment of the invention, the dispenser body is generally rectangular and the aligned, opposing laterally spaced surfaces are formed on opposing sides of the generally rectangular body.

The dispenser may further include means adapted for securing the dispenser to a surface to facilitate one handed sequential removal of individual tape handles from the pad.

BRIEF DESCRIPTION OF THE DRAWINGS

The present invention will be further described with reference to the accompanying drawing wherein like reference numerals refer to like parts in the several views, and wherein.

DETAILED DESCRIPTION OF THE INVENTION

Figure 3:
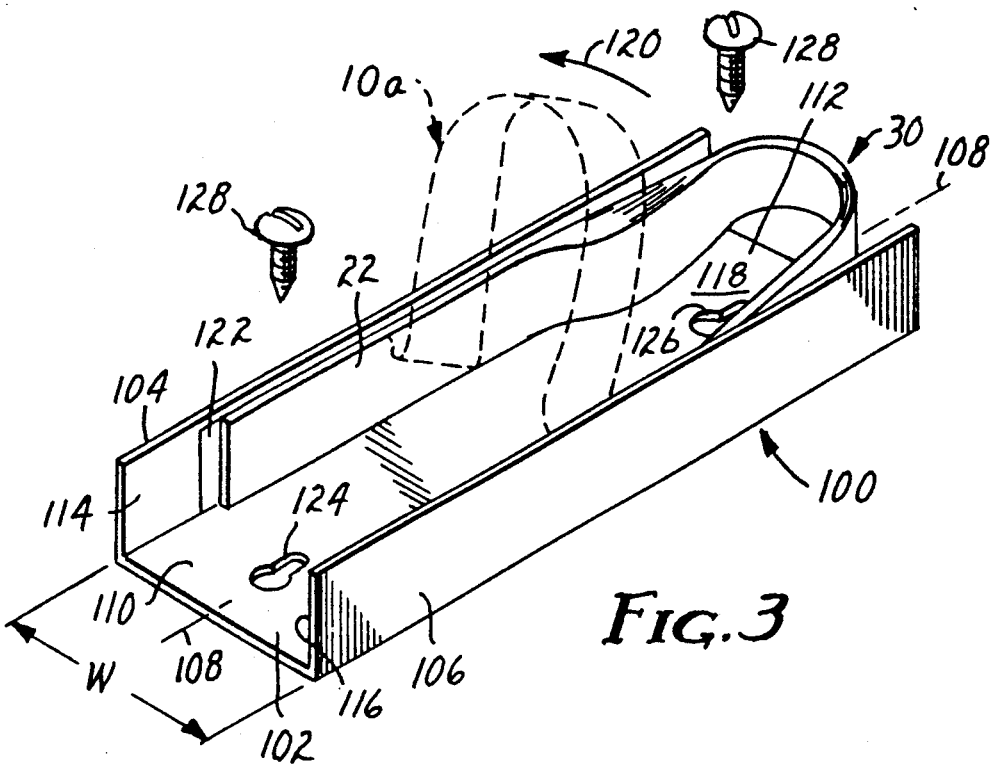
FIG. 3 is an isometric view of a padded tape handle dispenser according to the present invention containing a pad of tape handles.

Referring now to FIG. 3, a dispenser 100 for padded tape handles is shown. The dispenser 100 is includes base 102 and a pair of aligned opposing laterally spaced side walls 104 and 106 extending from the base. Preferably the side walls 104 and 106 are parallel and the dispenser forms a externally U-shaped member. The base 102 and side walls 104 and 106 define a longitudinal axis 108, a first end 110 and a second end 112 for the dispenser. The illustrated embodiment of the dispenser may be constructed of any suitable material having sufficient strength for the intended use, including, but not limited to, sheet metal bent into the desired shape.

Figure 1:
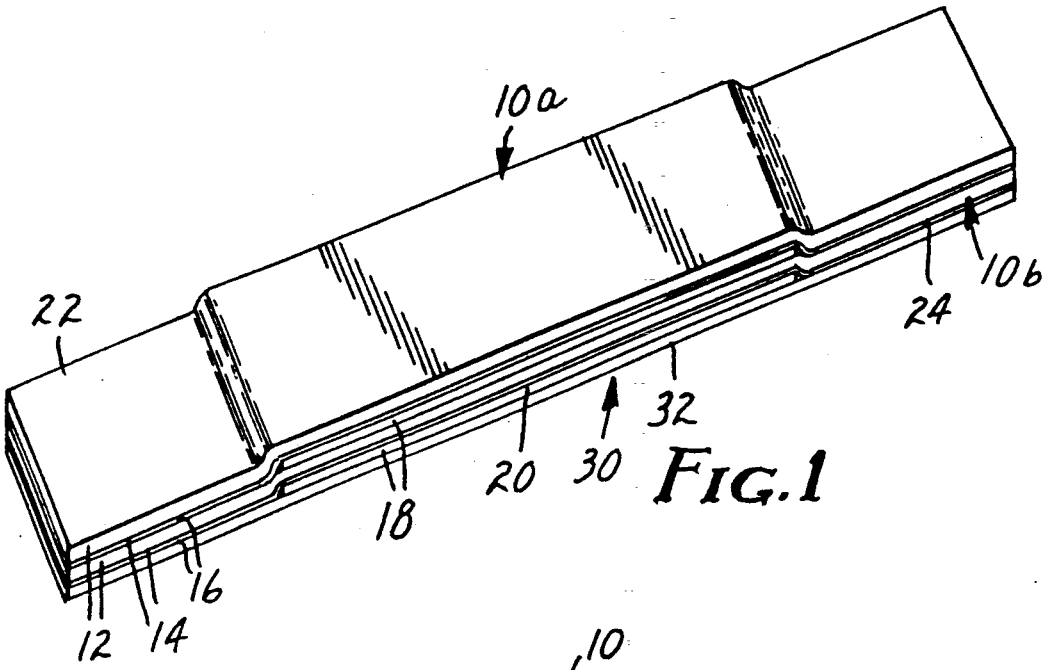
FIG. 1 is an isometric view of a conventional pad of tape handles with a removable release liner.

Side walls 104 and 106 include aligned opposing, preferably parallel, inner surfaces 114 and 116. As shown in FIG. 3, a pad 30 of reciprocally adhered tape handles as shown in FIG. 1 may be prepared by removing a release liner (not shown). The padded tape handles may be provided in any form found advantageous. However, in the preferred embodiment of the invention, the padded tape handles are available from Minnesota Mining and Manufacturing Company of St. Paul, Minnesota, under the trademark "Scotch Pad" Brand Carry Handles.

Figure 2:
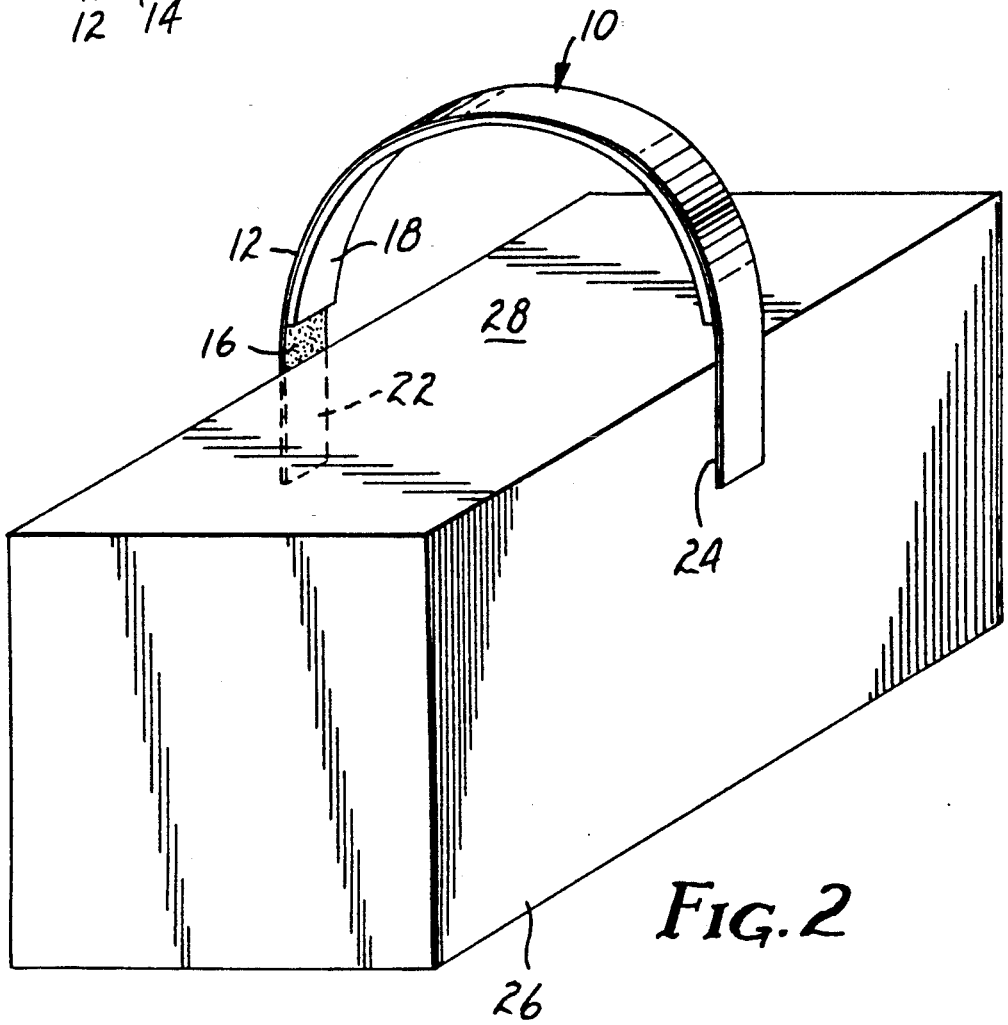
FIG. 2 is an isometric view of a tape handle as shown in FIG. 1 applied to an object.

The exposed pressure sensitive adhesive coated end sections 22 and 24 of the lowermost (as previously defined herein) tape handle in the pad are then each applied to one of the opposing inner surfaces 114, 116 in the manner shown in FIG. 3 adjacent the first end 110 of the dispenser. The intermediate non-adhesive portions of the tape handles extend towards the second end 112 of the dispenser to form a loop 118. Each tape handle 10 in the pad 30 is thus presented for sequential dispensing from the dispenser. The uppermost (as previously defined herein) tape handle 10*a* is grasped in the intermediate, non-adhesive portion and pulled in direction 120 towards the first end 110 of the dispenser 100. Preferably, the tape handle is pulled obliquely with respect to the base 102 of the dispenser, rather than parallel to the base. Once dispensed, the tape handle may be applied to an object, as in FIG. 2.

The side walls 104 and 106 are spaced apart from each other by a width "W". The width "W" may be varied, but it is believed that for a specific tape handle having a particular size and pressure sensitive adhesive coating, that a preferred range or value of "W" may be determined and the dispenser constructed accordingly. If the width "W" is too narrow for a given tape handle, the tape handle to be dispensed is difficult to grasp and to pull from the pad in the dispenser. A width "W" that is too wide exhibits the tendency for the tape handle to "curl" on itself when dispensed.

Means may be provided to facilitate the removal of the lowermost tape handle that is directly adhered to the inner surfaces of the side walls of the dispenser, without damage to the lowermost tape handle in the pad. In the illustrated embodiment of the invention, the removal means takes the form of strips of target tape 122 secured to the side walls in opposing positions (only one of which is shown in FIG. 3). The pressure sensitive adhesive ends 22, 24 of the lowermost handle are each adhered to one of the target tapes 122. The adhesion properties of the target tape may be selected, such as by application of a suitable low adhesion backsizing (LAB) to the non pressure sensitive adhesive side of the tape, to limit the force of adhesion between the layer of pressure sensitive adhesive on the end portions of the lowermost tape handle and the target tape, and thus the force required to remove the lowermost tape handle from the dispenser to a level that enables the last, or lowermost tape handle to be removed from the dispenser without damage to the tape handle. Such LAB's are commonly coated on the non-adhesive surface of tapes supplied in roll form, to facilitate unwinding of tape from the roll. Tapes such as No. 375 Brand Pressure Sensitive Adhesive Tape available from the Minnesota Mining and Manufacturing Company may be utilized as target tape as part of the present invention.

Alternatively, the inner surfaces 114 and 116 of the dispenser may be treated or finished in manner (such as plasma treatment or forming a knurled surface) that limits the adhesive force required to remove the lowermost tape handle of a pad from the dispenser.

Means are provided for securely mounting the dispenser 100 to a surface (not shown) to facilitate the dispensing of the tape handles, and specifically the dispensing of the tape handles using one hand. In FIG. 3, the securing means takes the form of one or more holes (as at 124 and 126) in the base 102. Screws 128 or any like securing device may be employed to secure the dispenser to the surface by engaging holes 124 and 126 in a manner known in the art. The dispenser of the present invention may thus be securely mounted in a location enabling a tape handle to be quickly and conveniently applied to a desired object, without requiring a second hand to hold either the dispenser or the pad of tape handles.

If desired, indicia (not shown) may be applied to the dispenser to provide directions for use, advertising or the like.

Figure 4:
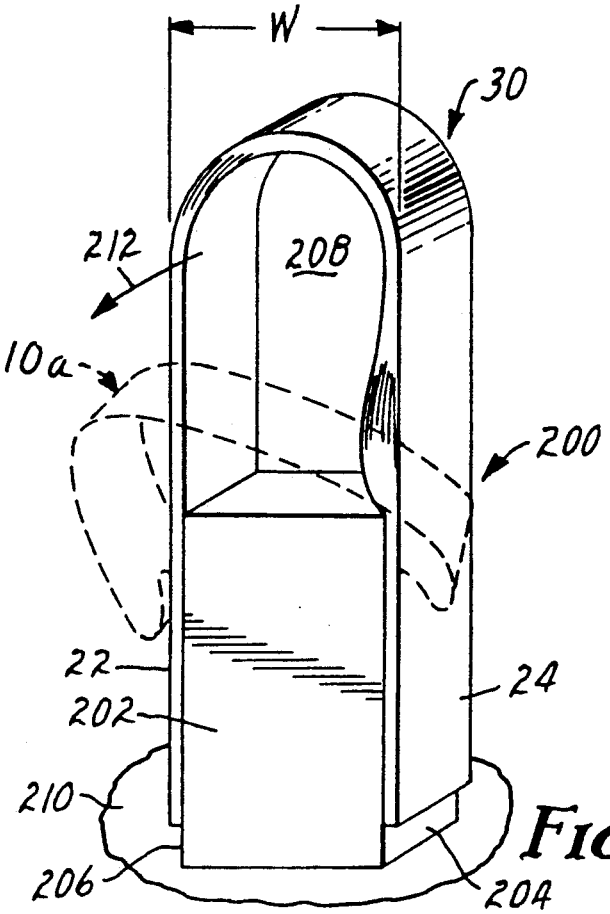
FIG. 4 is an isometric view of an alternate embodiment of the padded tape handle dispenser of the present invention.

FIG. 4 illustrates another alternate embodiment 200 of the invention, wherein the dispenser includes an upright member 202 having a pair of aligned opposing, laterally spaced surfaces 204 and 206. Preferably, the pad of tape handles 10 is secured to the dispenser 200 by adhering the exposed pressure sensitive adhesive end surfaces 22 and 24 of the lowermost tape handle in the pad to form loop 208 presented for manual engagement. However, in the embodiment illustrated in FIG. 4, the exposed pressure sensitive adhesive sections face each other, as compared to the embodiment of the invention illustrated in FIG. 3 wherein the exposed pressure sensitive adhesive surfaces face away from each other.

The upright member 202 may be mounted on a surface 210 in any convenient manner known in the art and the tape handles dispensed from the pad as shown, by pulling the outermost tape handle 10a in direction 212. As in the embodiment shown in FIG. 4, the surfaces 204 and 206 are preferably parallel and spaced apart by a distance "W".

The dispenser 200 may be constructed of any suitable material, but may conveniently be constructed of a monolithic molded body of a polymeric material and may include indicia (not shown) including instructions, advertising or the like.

FIGS. 5–8 illustrate an alternate embodiment 300 of the invention including base 302 and aligned opposing, laterally spaced side walls 304 and 306. Preferably, side walls 304 and 306 are parallel. Base 302 defines a first end 310 and a second end 312 and a longitudinal axis 308. Cover 320 is attached to base 302 by hinge portion 326. End and side flanges 324 extend from cover 320. End portion 322 extends from base 302 at first end 310 between side walls 304 and 306.

Figure 8:
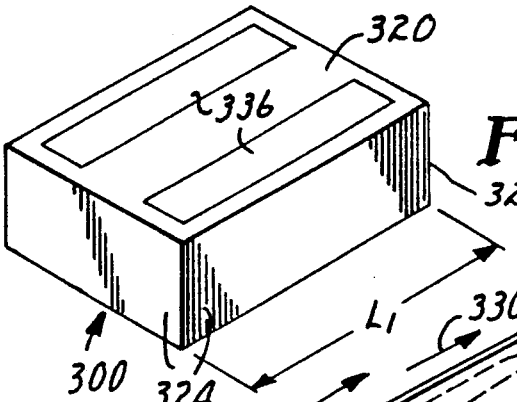
FIG. 8 is an isometric view of the padded tape handle dispenser of FIGS. 5–7, with the dispenser in a closed position.
Figure 5:
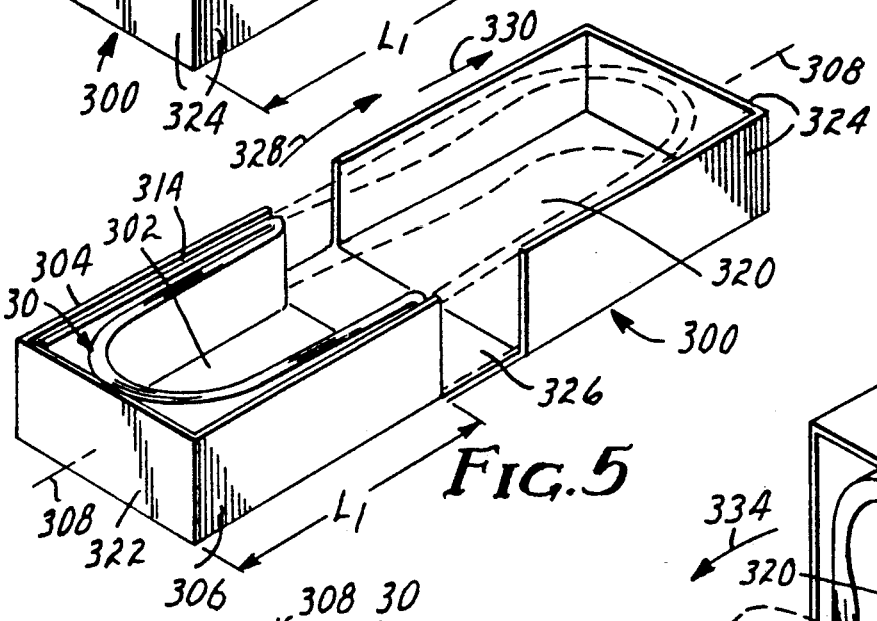
FIG. 5 is an isometric view of another alternate embodiment of the padded tape handle dispenser of the present invention in a open position and the pad of tape handles retracted.
Figure 6:
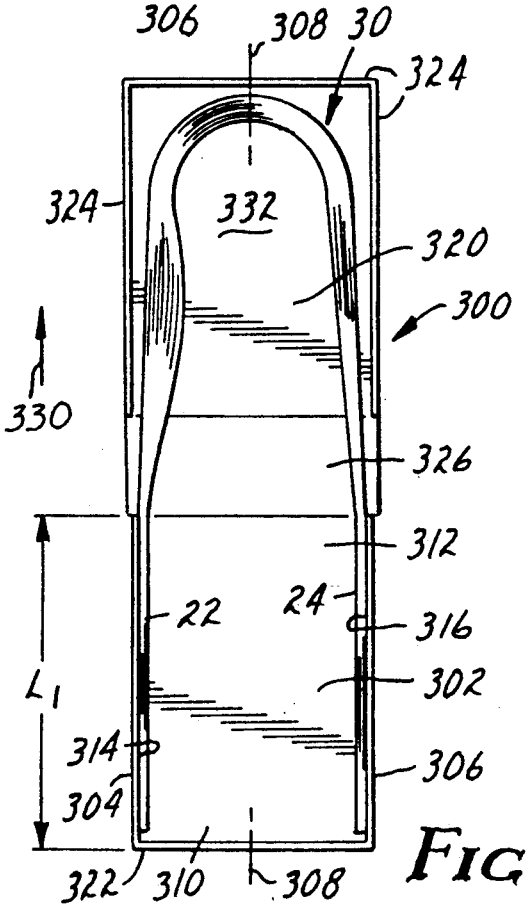
FIG. 6 is a top view of the padded tape handle dispenser of FIG. 5, with the pad of tape handles extended.
Figure 7:
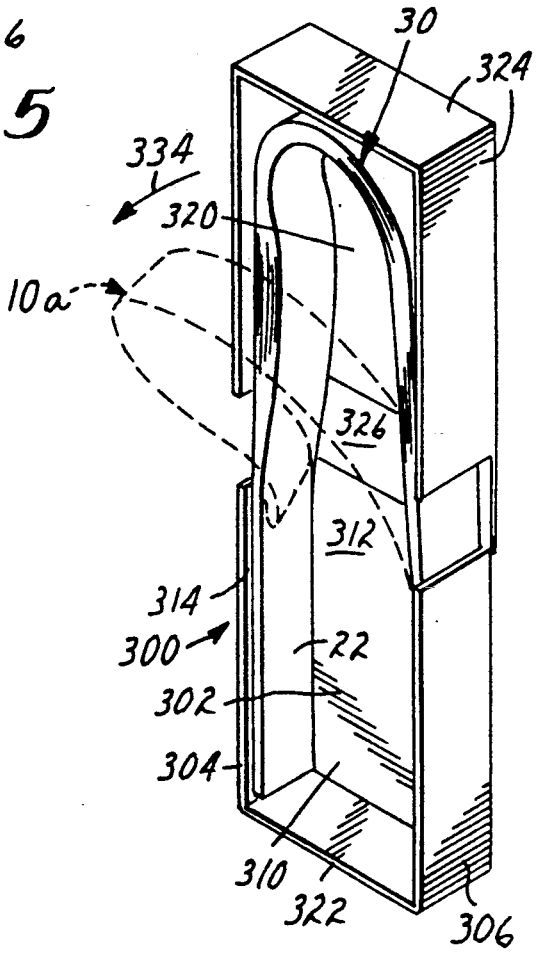
FIG. 7 is an isometric view of the padded tape handle dispenser of FIG. 6 with the pad of tape handles in an extended position and illustrating the removal of the uppermost tape handle.

The cover 320 may be placed in a first, closed position shown in FIG. 8, to enclose the padded tape handles within the dispenser, with the end and side flanges 324 placed about the side walls 304 and 306 and end wall 324. This configuration is convenient for shipping and storage of the dispenser, since the length L1 of the dispenser in this configuration may be shorter for a specific pad of tape handles, than the corresponding length of the dispensers 100 or 200, shown in FIGS. 3 and 4, respectively. The dispenser may be shifted to a second, open position, shown in FIGS. 5–7, by rotating cover 320 about hinge 326 in direction 328 so as to be aligned with base 302 and longitudinal axis 308.

A pad 30 of tape handles 10 may be secured to the aligned, opposing laterally spaced inner surfaces 314 and 316, respectively, of side walls 304 and 306, adjacent to first end 310 in the manner hereinabove described. When the dispenser is in the first, closed position as in FIG. 8, the intermediate non-adhesive portions of the tape handles are shifted towards first end 310 of the base. When the dispenser is shifted to the second, open position as in FIGS. 5–7, the intermediate non-adhesive portions of the tape handles are moved in direction 330 towards and beyond second end 312 of the base, to an extended position.

The extended intermediate non-adhesive portions of the tape handles forms loop 332. The tape handles may then be sequentially dispensed (as shown in FIG. 8) in the manner herein described with respect to FIG. 3 by pulling the outermost tape handle 10a in direction 334.

Figure 10:
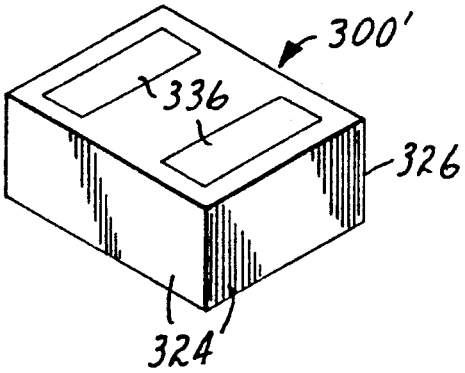
FIG. 10 is an isometric view of the padded tape handle dispenser of FIG. 9; and, FIG. 11 is a plan view of the padded tape handle dispenser of FIGS. 9 and 10, with the cover of the dispenser in a second, open position and the intermediate non-adhesive portions the pad of tape handles in an extended position to form a loop.
Figure 9:
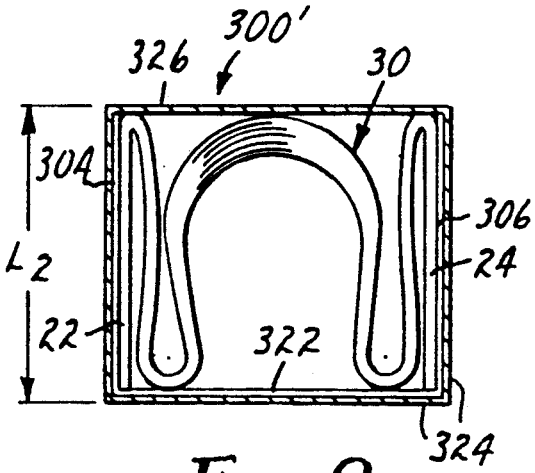
FIG. 9 is a cross sectional view of yet another alternate embodiment of the padded tape handle dispenser of this invention with a cover in a first, closed position and the pad of tape handles in a retracted position.
Figure 11:
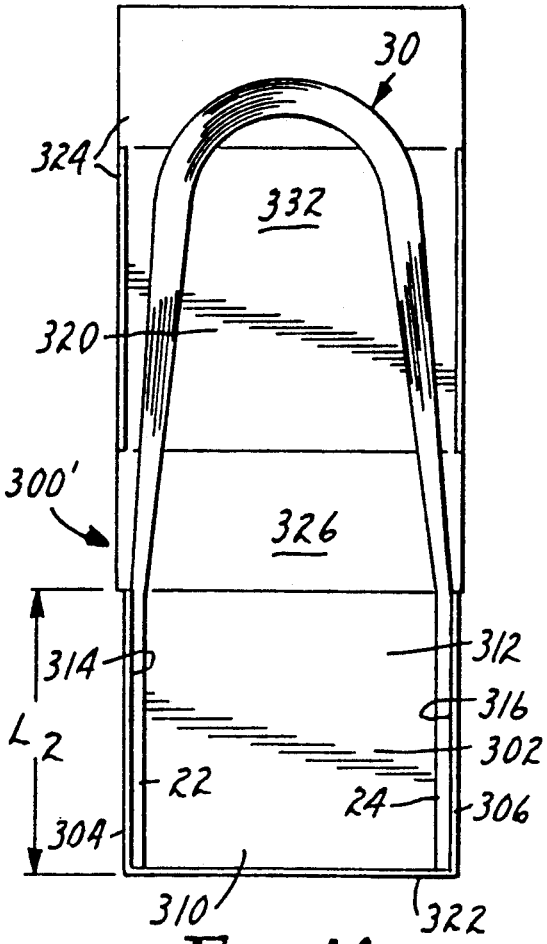

Yet another alternate embodiment 300' of the dispenser is shown in FIGS. 9–11. This embodiment is substantially similar to the embodiment shown in FIGS. 5–8, except that base 302 has a length L2 that is approximately one half of the length L1 of the embodiment in FIGS. 5–8. This enables the pad 30 of tape handles to be "double-folded" as shown in FIG. 9, when the dispenser is in the first, closed position. In all other respects, the extension of the intermediate non-adhesive portions of the tape handles (as in FIG. 11) and the dispensing of individual tape handles is as herein described. However, dispenser 300' provides a configuration that is even more compact than the dispenser 300 in FIGS. 5–8. It may be necessary or desirable for the end flange 324 of the cover to be folded down in line with base 302 and cover 320 when the dispenser is in its second, open position in order to accommodate the extended length of the pad of tape handles.

In the preferred embodiments of the invention as shown in FIGS. 5–8 and 9–11, the dispenser (300, 300') may be constructed of corrugated cardboard or chipboard, and thus be disposed of when empty. Means may be provided (not shown), such as segments of pressure sensitive adhesive tape to temporarily secure the cover to the base when in the closed position prior to use.

Alternate means for securing the dispenser to a surface are shown in FIGS. 8 and 10, wherein one or more segments 336 of a pressure sensitive adhesive strip are secured to the outer sides of the base or side walls of the dispenser. The pressure sensitive adhesive strip may take the form of a segment of double coated pressure sensitive adhesive tape (such as Nos. 4016 and 4032 Double Coated Urethane Foam Pressure Sensitive Adhesive tape available from the Minnesota Mining and Manufacturing Company of St. Paul, Minnesota) or a segment of adhesive transfer tape (such as No. 950 Brand Pressure Sensitive Adhesive tape available from the Minnesota Mining and Manufacturing Company of St. Paul, Minnesota). Each of the tape segments is covered by a release liner (not shown) prior to use. Once the release liner is removed from the tape segments 336, the exposed pressure sensitive adhesive tape strips may then be applied to a desired surface to secure the dispenser during use.

Other alternate securing means include, but are not limited to, suction cups (not shown), magnetic strips (not shown) or a coated layer or a tape including a coated layer of repositionable pressure sensitive adhesive (similar to that shown in FIGS. 8 and 10) applied to the base opposite the pad of tape handles. Such repositionable pressure sensitive adhesives are available on various products available from the Minnesota Mining and Manufacturing Company, St. Paul, Minnesota under the trademark "Post-It". Each of these alternate securing means secure the dispenser to a surface with sufficient strength to enable the dispenser to be used as herein described, yet enable the dispenser to be detached from a surface and thereafter repositioned and reapplied to a different surface. In any of the above embodiments of the invention, the dispenser may be applied by the securing means to a vertical, horizontal or inclined surface, or inverted, and function as otherwise herein described.

The present invention has now been described with reference to multiple embodiments thereof. It will be apparent to those skilled in the art that many changes can be made in the embodiments described without departing from the scope of the present invention. Thus, the scope of the present invention should not be limited to the structures described in this application, but only by structures described by the language of the claims and the equivalents of those structures.

What is claimed is:

1. A dispenser for a pad for reciprocally releasably adhered tape handles extending from an uppermost tape handle to a lower most tape handle, each of the handles having an intermediate non-adhesive portion and pressure sensitive adhesive coated end portions on either side thereof, comprising:

(a) a body having a pair of aligned, opposing laterally spaced surfaces, each of said laterally spaced surfaces for receipt of one of the pressure sensitive adhesive coated end portions of the lowermost tape handle in the pad of tape handles to secure the pad of tape handles to the dispenser, with the intermediate non-adhesive portion of the tape handles in the pad extending to form a loop for manual engagement to facilitate sequential dispensing of individual tape handles form the pad; and (b) a segment of target tape applied to said opposing aligned laterally spaced surfaces for controlling the strength of adhesion of the lowermost tape handle of the pad that is applied to said opposing laterally spaced surfaces.

2. A dispenser, comprising:

(a) a body having a pair of aligned, opposing laterally spaced surfaces;

(b) said body of the dispenser further including a cover hingedly connected to an end of said base, wherein said cover may be shifted between a first, closed position parallel to and spaced from said base, and a second, open position aligned with said base; and (c) a pad of reciprocally adhered tape handles extending from an uppermost tape handle to a lowermost tape handle in the pad, each tape handle including an intermediate non-adhesive portion and pressure sensitive adhesive coated end portions on either side thereof, said pressure sensitive adhesive end portions of said lowermost tape handle in said pad each being adhered to one of said opposing, parallel, laterally spaced surfaces of said dispenser body, with the intermediate non-adhesive portions of the pad of tape handle being retracted when said cover is in said first, closed position and extendable to form a loop when said cover is shifted to said second, open position, said loop adapted to facilitate manual engagement to grasp and sequentially dispense individual tape handles from the pad.

3. In combination:

(a) a dispenser having base including a pair of opposing, laterally spaced side plates extending from said base, said side plates such having an opposing aligned laterally spaced inner surface; and (b) a pad of a plurality of releasably reciprocally adhered tape handles extending from an uppermost to a lowermost tape handle in said pad, each tape handle including an intermediate non-adhesive portion and pressure sensitive adhesive coated end portions on either side thereof, said pressure sensitive adhesive end portions each being adhered to one of said opposing, laterally spaced inner surfaces of said side plates, with said intermediate non-adhesive portions of said tape handles of said pad extending to form a loop adapted to facilitate manual engagement and sequentially dispensing of individual tape handles from said pad.

4. The combination of claim 3, said dispenser further including means for securing said base of said dispenser to a surface.

5. The combination of claim 4, wherein said securing means includes at least one hole in said base and mechanical fastening means for engaging said hole in said base for attachment to a surface to secure said dispenser thereto.

6. The combination of claim 4, wherein said securing means includes at least one strip of a double coated pressure sensitive adhesive tape secured to said base opposite said side walls for adhering the dispenser to a surface.

7. The combination of claim 3, wherein said cover further includes a pair of aligned laterally spaced side flanges and an end flange depending therefrom.

8. The combination of claim 3, wherein said body of said dispenser further includes a cover hingedly connected to an end of said base, wherein said cover may be shifted between a first, closed position parallel to and spaced from said base for enclosing said pad of tape handles therebetween prior to use, and a second, open position aligned with said base for dispensing said tape handles from the dispenser, wherein said intermediate non-adhesive portions of said pad of tape handle are retracted when said cover is in said first, closed position and said intermediate non-adhesive portions are extendable to form said loop when said cover is shifted to said second, open position.

* * * * *